United States Patent [19]

Anderson

[11] 4,384,723

[45] May 24, 1983

[54] DEFENSIVE TARGET APPARATUS

[76] Inventor: Lawrence E. Anderson, 3411 Moon St., Alexandria, Va. 22306

[21] Appl. No.: 207,774

[22] Filed: Nov. 17, 1980

[51] Int. Cl.[3] ..... F41J 3/00; A63F 9/02

[52] U.S. Cl. ..... 273/387; 273/385; 273/398; 273/408; 273/419

[58] Field of Search ..... 273/348, 383, 384, 385, 273/387, 394, 395, 408, 398

[56] References Cited

U.S. PATENT DOCUMENTS

| | | | |
|---|---|---|---|
| 2,488,059 | 11/1949 | Greenberg | 273/348 |
| 2,808,266 | 10/1957 | Rose | 273/398 |
| 3,623,065 | 11/1971 | Rockwood et al. | 273/395 X |
| 3,731,932 | 5/1973 | Breslow et al. | 273/384 |
| 3,790,173 | 2/1974 | Callaway | 273/371 |
| 4,155,553 | 5/1979 | Lin | 273/384 X |
| 4,186,926 | 2/1980 | Kulesza et al. | 273/384 X |

*Primary Examiner*—Anton O. Oechsle

[57] ABSTRACT

A defensively orientated target assembly or apparatus comprising a main target capable of receiving projectiles and subtargets which when struck act to dislodge projectiles previously situated in strategic positions within the main or primary target. An offensive score is accomplished by landing the projectile within a subsection of the main or primary target. Subsequently, an opponent may dislodge the projectile by successfully striking the associated subtarget.

19 Claims, 9 Drawing Figures

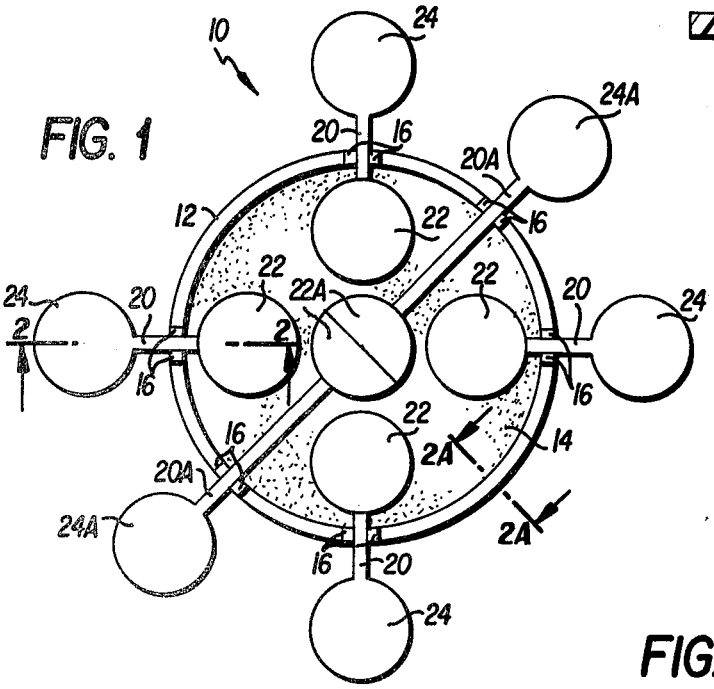
FIG. 1
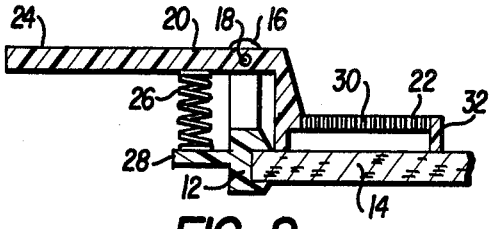
FIG. 2
FIG. 2A
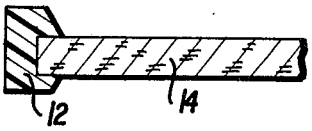
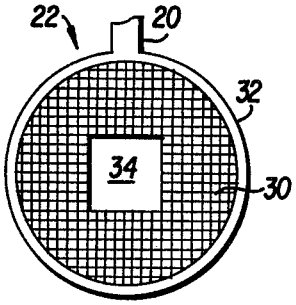
FIG. 3
FIG. 5
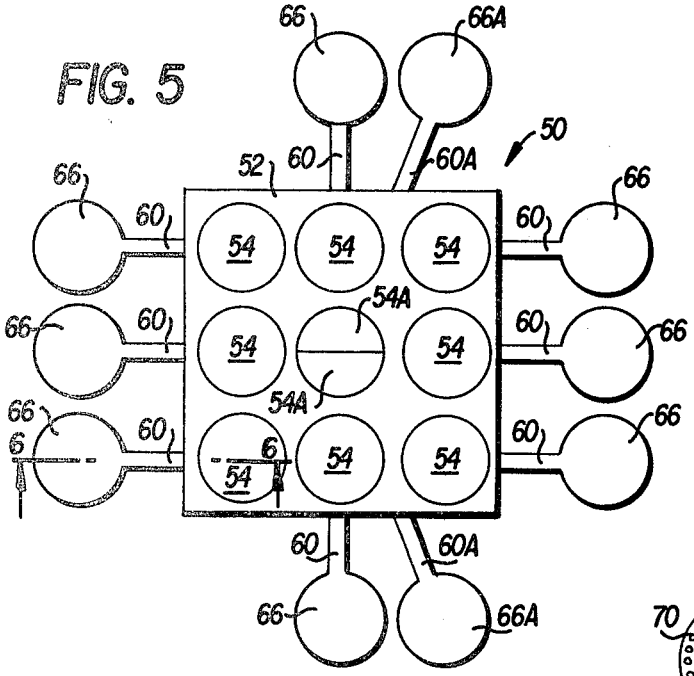
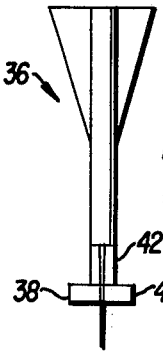
FIG. 4
FIG. 6
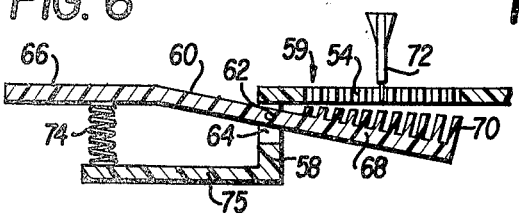
FIG. 7
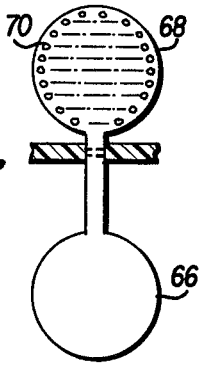
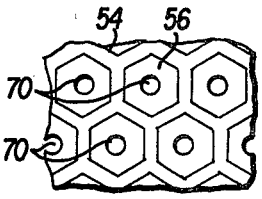
FIG. 8

DEFENSIVE TARGET APPARATUS

BACKGROUND OF THE INVENTION

Targets in the prior art are generally offensively orientated as participants compete in a positive manner to position successive dart throws on the board to score the alotted point value. To facilitate the return of the darts mechanisms have been utilized to effectively move the dart away from the base portion to dislodge it from the target. However, such dislodging of the dart from the target is not a part of the game itself and only occurs after the game interval is completed.

A serious deficiency exists in the game of darts since unlike games such as shuffle board or horseshoes, there is no defensive capability. Some magnetic games have used magnetism to repel (defensively) an opponent's playing object, however, such a form is not easily adapted to the game of darts.

OBJECTS OF THE INVENTION

It is therefore an object of the present invention to provide a target apparatus having both offensive and defensive (point removing) capabilities.

It is a further object of the present invention to provide a target apparatus adapted to fit over the standard sized dart board so as to convert it to a defensive game as well as offensive.

Another object of the present invention is to provide a target apparatus which is made from inexpensive materials and can be easily manufactured.

Yet another object of the present invention is to provide a long awaited variance to the ancient game of darts which will stimulate new interest, yet be safe and practical.

SUMMARY OF THE INVENTION

Accordingly, the present invention provides a target apparatus comprising a plurality of primary target means adapted to receive a first set of projectile means, such as darts. Operatively associated with each set of primary target means is at least one of a plurality of discharge means. The discharge means are actuated by the striking of secondary target means. The secondary target means are adapted to be struck by one of a second set of projectile means, which may either be the same as the first projectile means (i.e. darts) or of a different form such as a ball or bean bag. In one form of the invention said discharge means are rigidly connected to said secondary target means by a pivot arm means. Pivot means allows the pivot arm means to pivot when said secondary target means is struck by said secondary projectile means. The pivoting actuates the discharge means to dislodge any first projectile means in the associated area.

BRIEF DESCRIPTION OF THE DRAWINGS

Many of the attendant advantages of the present invention will be readily apparent as the invention becomes better understood by reference to the following detailed description with the appended claims, when considered in conjunction with the accompanying drawings, wherein:

FIG. 1 is a front schematic view of the preferred embodiment of the present invention.

FIG. 2 is a partial cross sectional view of a portion of the FIG. 1 embodiment taken along lines 2—2.

FIG. 2A is a close-up cross sectional view taken along lines 2A—2A in FIG. 1.

FIG. 3 is an enlarged close-up view of the grid pattern of the discharge means of the target apparatus of FIG. 1.

FIG. 4 is a specially adapted conventional dart intended for use with the target apparatus of FIG. 1.

FIG. 5 is a front schematic view of another embodiment of the present invention.

FIG. 6 is a partial cross sectional view taken along lines 6—6 of FIG. 5.

FIG. 7 is a front view of one of the secondary target means coupled with a discharge means of the FIG. 5 embodimant.

FIG. 8 is a close-up of a portion of the honeycomb-like primary target means of the FIG. 5 embodiment also revealing the protrusions of the discharge means in the free space within the individual cells.

DESCRIPTION OF THE PREFERRED EMBODIMENTS

Referring now to the drawings, wherein like reference characters designate like or corresponding parts throughout the several views, FIG. 1 shows a target assembly or apparatus 10 having a flexible rim 12 which encircles a conventional, portable dart target 14. FIG. 2A is a close-up view of the flexible rim 12 engaging target 14 in a conventional manner. To permit flexure, yet retain rigidity for stability, rim 12 may be made of polymer plastics which are chosen with the appropriate characteristics and are well known to those skilled in the art. Protruding outwards, as seen in FIG. 1, from rim 12 are posts 16 which provide a pivot point in much the same way as the base of a teeter totter. However, as a substitute for posts 16 a solid side wall could be utilized to increase rigidity. Pivot rod 18 functions as the pivot point for pivot arms 20. Pivot arms 20 are generally "L" shaped and rigidly connect the discharge means or grid assemblies 22 with the secondary target plates 24 as best seen in FIG. 2. Obviously a variety of mechanical connections beteewn the secondary target plates 24 and grid assemblies 22 could be utilized to provide simple mechanical motion. A spring 26 biases the secondary target plate 24 outward and and the grid assembly 22 against the target 14. An abutment plate 28 is rigidly attached to rim 12 to provide a stationary abutment for spring 26.

Referring now to FIG. 3, an enlargement relative to FIG. 1 but actually less than actual size, the grid assembly 22 (which constitutes the discharge means) includes a grid 30 made of hard metal so as to withstand the striking of darts and not deteriorate appreciably. The grid 30 is supported by rim 32 which also spaces the grid 30 from target 14. Grid 30 optionally may include a free or open space 34 which provides a secure space on target 14 which cannot be subjected to the discharging forces of grid 30. It can be readily appreciated by those skilled in the art that a conventional dart thrown against target 14 within grid 30 will enter between the wires of grid 30 and penetrate target 14 in a conventional manner. The rules of the game will normally define the primary targets as being within the circumference of rims 32. Thereafter an opponent may throw a second projectile (which may also be a dart, or a ball, bean bag or the like) against a secondary target plate 24. Upon being struck, the secondary target plate 24 will cause pivot arm 20 to pivot, thereby causing grid assembly 22 to move away from target 14 so as to discharge the previously thrown dart from target 14.

Positioned centrally in target assmbly 10 are central grid assemblies 22A actuated by pivot arms 20A when secondary targets 24A are struck. The grid assemblies 22A, pivot arms 20A, and secondary targets 24A are identical in function to the corresponding grid assemblies 22, pivot arms 20 and secondary target plates 24, however the grid assemblies 22A and pivot arms 20A are configured somewhat differently.

Referring now to FIG. 4, there is shown a conventional dart 36 having an adapter 38 to facilitate use with the grid assemblies 22. The adapter 38 comprises a washer-like base 40 rigidly attached to a cylindrical sleeve 42 which tighly engages the needle-like point of the dart 36. The adapter 38, which is optional, provides an abutment surface as base 40 will abut grid 30 during operation so as to provide a greater discharging surface.

The foregoing embodiment may also be modified for use with dart targets having pin-like protrusions which hold darts having mating protrusions in place. This type of dart target may be accommodated for use with the embodiment of FIG. 1 simply by making the grid openings of grid 30 sufficiently large so as to surround the pin-like protrusions and provide sufficient clearance for movement of the grid assemblies 22 in response to the striking of a secondary target plate 24.

Referring now to FIG. 5, there is shown an alternate embodiment of the present invention configured in the shape of a "tic-tac-toe" board. Obviously specially marked darts having "X's" and "O's" visibly configured thereon may be used to produce the conventional "tic-tac-toe" scoring in a manner well known to those skilled in the art. The target assembly 50 includes a base portion 52 having penetrable primary grid portions 54 and central semicircular target grid portions 54A. The primary target grid portions 54,54A are honeycomb-like in structure as is well known to those skilled in the art so as to be capable of receiving a dull pointed, safety-type dart whose cylindrical shaft is just slightly smaller in diameter than the grid openings. FIG. 8 is a close-up of a portion of grid 54 which reveals the approximate configuration of a grid opening 56. However, similar opening or gripping configurations could be utilized to achieve similar results.

Base portion 52 includes side portions 58, and secondary target and discharge assemblies 59, one of which is shown in FIG. 6. The secondary target and discharge assemblies include pivot arms 60 which are pivotably mounted by pivot pins 62. For ease of assembly, the pin 62 may be rigidly attached to the pivot arm 60 with the side opening 64 being closely conformed and having indentations which receive the ends of pin 62 so as to provide pivoting in a conventional manner. The pivot arms 60 rigidly connect secondary targets 66 to the discharging plates 68. However, alternately a series of mechanical components could be used to transmit the mechanical action with a similar effect. Positioned rigidly on discharging plate 68 are a series of pins, posts or protrusions 70, as illustrated schematically in FIGS. 6,7, and 8. Note that number and size (length and width) is not shown correctly in FIGS. 6,7, and 8 as these showings are for illustrational purposes only and the actual size depends on the size of the dart shaft, the size of the opening in the target grid, and the strength of the materials used. The entrance of the protrusions 70 into primary target grid portion 54 is best illustrated in FIG. 8. Note that while there is sufficient clearance between the grid portion 54 and protrusions 70 so as to allow free passage, at the same time protrusion 70 can safely discharge any dart 72 (as seen in FIG. 6) located within the grid opening 54.

Secondary targets 66A operate in conjunction with semicircular target grid portions 54A in a manner similar to subassembly 59 shown in FIG. 6, but are merely configured differently and have extended pivot arms 60A attached thereto which are configured so as not to interfere with the actuation of adjacent discharging plates 68. Discharge plates 68 are biased into nonactuated or nondischarging positions by springs 74 which extend from secondary target plates 66 to abut base extensions 75.

In operation, it can be readily appreciated by those skilled in the art that after a dart 72 has penetrated primary target grid portion 54 an opposing player may throw a second projectile, which may be in the form of a dart, ball, bean bag, or the like, at a secondary target plate 66 to force the secondary target plate 66 down (as seen in FIG. 6) or back (as seen in FIG. 5) thereby initiating a pivot action. Discharging plate 68 associated therewith will consequently pivot upwards (as seen in FIG. 6) or forward (as seen in FIGS. 5 and 7) whereupon protrusions 70 will pass into the corresponding grid openings 56 to discharge any dart located therein.

Target assemblies 10, 50 preferably are mounted on vertical surfaces by conventional means, i.e. hooks, nails, or the like, but may be placed on a horizontal surface as well. In playing a game of tic-tac-toe each player may be supplied with a given total of projectiles, for example nine. He may chose (before the game begins) to include in that number some defensive projectiles (bean bags for example) as well as offensive projectiles (darts). During the game, in which the object is to get three of one player's darts in a row, the player may chose as his turn to throw a defensive projectile, such as a bean bag, to dislodge the projectile of the opponent. As shown for the first embodiment, and naturally includable in the second embodiment, there may be safety zones 34 or tertiary targets (FIG. 3) in which no defensive discharging effort will work. These can be created by removing the protrusions or grid wires in the corresponding areas. As stated, a strategy is involved both in choosing the type of projectiles, offensive or defensive totaling a certain number, and deciding which type of projectile, offensive or defensive, to throw.

Obviously, other embodiments and modifications of the present invention will readily come to those of ordinary skill in the art having the benefit of the teachings presented in the foregoing description and drawings. It is, therefore, to be understood that this invention is not to be limited thereto and that said modifications and embodiments are intended to be included within the scope of the appended claims.

What is claimed and desired to be secured by Letters Patent of the United States is:

1. A target apparatus having defensive capability comprising:

penetrable stationary primary target means adapted to receive projectile means which penetrate therein;

a plurality of discharge means operatively associated with said primary target means for discharging a projectile means from said primary target means;

said discharge means having activated and inactivated positions;

a plurality of secondary target means adapted to be struck by a projectile means each operatively associated with and adapted to activate said discharge means and move said discharge means relative to said primary target means in response to being struck by a projectile means;

whereby when a projectile means is received by said primary target means a projectile means may be discharged from said primary target means by striking the associated secondary target means with a projectile means thereby activating the associated discharge means.

2. A target apparatus having defensive and offensive capabilities comprising:

means forming at least one stationary primary target adapted to engage and receive a projectile;

a plurality of independently movable discharge means for engaging and discharging projectiles from said primary target means;

secondary target means for activating said discharge means in response to being struck by a projectile, said discharge means engaging a projectile within one of said primary target means upon being activated, said secondary target means being movable relative to said primary target means;

whereby after a projectile is received by said primary target means, said secondary target means may be struck by a projectile to activate said discharge means operatively associated therewith upon movement of said secondary target means relative to said primary target means such that a projectile is discharged from said primary target means.

3. The invention as recited in claim 1 or 2 further including pivot means for activating said discharge means whereby the striking of said secondary target means causes said pivot means to pivot thereby activating said discharge means.

4. The invention as recited in claim 2 wherein said pivot means further includes pivot arm means which directly and rigidly connects said discharge means to said secondary target means.

5. The invention as recited in claim 1 wherein said primary target means is adapted to be penetrated by a projectile means so as to engage a projectile by substantially surrounding a portion thereof such that a projectile may be rigidly positioned within a portion of said primary target means.

6. The invention as recited in claim 1 or 2 wherein said primary target means and said discharge means are at least partially coextensive.

7. The invention as recited in claim 1 or 2 further including biasing means whereby said secondary target means is biased into a position whereby said discharge means is normally biased into an inactivated position.

8. The invention as recited in claim 1 or 2 wherein said primary target means is positioned in a vertical plane and faces forwardly, and said discharge means moves forwardly to discharge said projectile means.

9. The invention as recited in claim 1 wherein said discharge means directly engages said projectile means to discharge said projectile means from said primary target means.

10. The invention as recited in claim 1 or 2 wherein there are a plurality of said primary target means and a plurality of said secondary target means.

11. The invention as recited in claim 9 wherein there is at least one associated secondary target means for each primary target means.

12. The invention as recited in claim 1 or 2 further including tertiary target means adapted to receive projectile means, said tertiary target means being coplanar with said primary target means.

13. The invention recited in claim 12 wherein said primary target means and said tertiary target means are integrally formed.

14. The invention recited in claim 1 or 2 wherein said primary target means and said secondary target means are vertically oriented during operation.

15. The invention recited in claim 1 or 2 wherein said primary target means and said secondary target means are both adapted to be struck by projectiles having the configuration of a dart, such a projectile operating to penetrate said primary target means.

16. The invention as recited in claim 15 constructed such that a game of darts may be played thereon.

17. The invention as recited in claim 1 or 2 wherein both said primary target means and said discharge means extend in parallel planes in overlapping fashion.

18. The invention as recited in claim 1 or 2 further comprising a main target portion, said main target portion comprising said primary target means and tertiary target means, said discharge means being incapable of discharging a projectile from said tertiary target means.

19. A target apparatus having defensive capability comprising:

penetrable stationary primary target means adapted to receive projectile means having the configuration of a dart which penetrate therein;

discharge means operatively associated with said primary target means for discharging a projectile means from said primary target means;

said discharge means having activated and inactivated positions;

secondary target means adapted to be struck by a projectile means having the configuration of a dart operatively associated with and adapted to activate said discharge means in response to being struck by a projectile means;

whereby when a projectile means is received by said primary target means a projectile means may be discharged from said primary target means by striking the associated secondary target means with a projectile means thereby activating the associated discharge means.

* * * * *